United States Patent [19]

Streeter

[11] Patent Number: 4,684,911

[45] Date of Patent: Aug. 4, 1987

[54] WIDE ANGLE CONTROL OF PERMANENT MAGNET ROTORS

[76] Inventor: Edward C. Streeter, 89 Park Place, Park Parade, Harrogate, N. Yorkshire, England, HG1 5NS

[21] Appl. No.: 776,601

[22] Filed: Sep. 16, 1985

[51] Int. Cl.[4] ..... H01F 7/02

[52] U.S. Cl. ..... 335/288; 335/306

[58] Field of Search ..... 335/288, 306, 207; 49/74, 89; 160/166 R, 176 R

[56] References Cited

U.S. PATENT DOCUMENTS

| | | | |
|---|---|---|---|
| 3,211,264 | 10/1965 | Streeter, Jr. | 49/89 |
| 3,524,281 | 8/1970 | Streeter, Jr. | 49/74 |
| 3,742,648 | 7/1973 | Streeter, Jr. | 160/176 X |

*Primary Examiner*—Patrick R. Salce

*Assistant Examiner*—Anita M. Ault

[57] ABSTRACT

Apparatus for holding a series of permanent magnet rotors having parallel transversely spaced coplanar rotational angles firmly at any of a wide range of desired angles without consumption of energy, the angles being linearly adjustable independently of rotor spacing and with constant torque sensitivity, by mechanically linking each rotor to an adjacent rotor to form pairs and arranging the magnetic axes mutually perpendicular and perpendicular to the axes of rotation, coupling each rotor to a direct magnetic control field component perpendicular to the plane which is common to the rotor axes and varying the amplitude ratio of the field components coupled to the rotors of a linked pair according to the tangent of a control angle to turn the rotors through a corresponding angle.

4 Claims, 7 Drawing Figures

WIDE ANGLE CONTROL OF PERMANENT MAGNET ROTORS

BACKGROUND OF THE INVENTION

1. Field of the invention

This invention concerns directional control of permanent magnets, and it is particularly applicable to the simultaneous control of a series of rotors that are rotatable about parallel transversely spaced coplanar axes. Such rotors are suitable for adjusting the attitudes of louvers having horizontal, vertical or inclined axes of rotation in daylight controlling screens.

2. Description of the prior art

Environmental screens have been described in the patent literature having ribbon-like louvers supported only at their ends, each end being attached to a permanent magnet rotor. The angle of the rotors is determined by equilibrium between a control torque produced by a direct magnetic field of adjustable strength and a restoring torque that tends to maintain each rotor at a predetermined angle of repose. The restoring torque is primarily produced by mutual magnetic coupling between adjacent rotors, and it is limited to about ±45 degrees rotation because of the double sinusoidal shape of the restoring torque curve. This type of control is therefore not suitable for louvers that require ±90 degrees rotation, for example, vertically hanging louvers. Furthermore, the choice of spacing between adjacent rotors is restricted because the magnetic coupling is inversely proportional to the third power of the spacing.

SUMMARY OF THE INVENTION

The principal object of the invention is to provide inexpensive non-contacting means for holding a series of permanent magnet rotors having parallel transversely spaced coplanar rotational axes firmly at desired angles without the consumption of energy, the angles being linearly adjustable over a wide range independently of the rotor spacing and with constant torque sensitivity.

The invention is embodied in apparatus for holding the rotors at any angle in the range of ±90 degrees, comprising means for mechanically linking each rotor to an adjacent rotor to form a plurality of rotor pairs wherein the magnetic axes are mutually perpendicular and perpendicular to the axes of rotation, means for coupling each rotor to a direct magnetic control field component perpendicular to the plane containing common to the rotor axes, and means for varying the amplitude ratio of the field components coupled to the rotors of a linked pair according to the tangent of a control angle to turn the pair of rotors through a corresponding angle. The adjacent rotor pairs effectively balance out restoring torques.

Clearly, the control field components can be electromagnetically produced by coils fixed opposite the rotors and energized by direct currents that are varied according to the sine or cosine of the control angle. However, such coils are relatively expensive to manufacture and continuously consume some electrical energy to hold the rotors firmly at the desired angle.

Accordingly, the invention more specifically includes means producing permanent magnetic control fields that are rotatable in unison about an axis parallel to the plane of the rotor axes, the magnetic axis of the control field that couples with one rotor being perpendicular to the control field that couples with its paired rotor, whereby the control torques induced in the linked rotors balance at angles equal to the rotational angles of the control fields.

BASIC THEORY OF OPERATION

A clear insight into the behavior of the permanent magnet rotors in the presence of control field magnets and each other can be obtained if ellipsoids having uniform magnetization are substituted for the actual magnets. This is not unrealistic because an ellipsoid may be given a prolate shape that is a good approximation of a practical magnet by suitable choice of major and minor axes. Each uniformly magnetized ellipsoid produces the same external effect as a dipole magnet of equal magnetic moment placed at its center and magnetized in the same direction.

Figure 1:
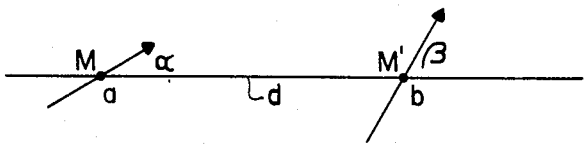
FIG. 1 is a diagram illustrating the geometrical relationship of certain mathematical terms.

Referring to FIG. 1, the torque $Q_{ab}$ on a dipole "a" of moment $M_a$ at a distance d from a dipole "b" of moment $M_b$ is $$Q_{ab}=M_aM_b[\sin\beta\cos\alpha-2\cos\beta\sin\alpha]/d^3 \quad (1)$$

where $\alpha$ and $\beta$ are the angles of the axes of the dipoles "a" and "b", respectively, with the line through the dipole centers. A positive sign indicates a torque tending to increase $\alpha$. The converse torque $Q_{ba}$ on the dipole "b" caused by the dipole "a" is obtained by interchanging $\alpha$ and $\beta$ in equation (1).

Figure 2:
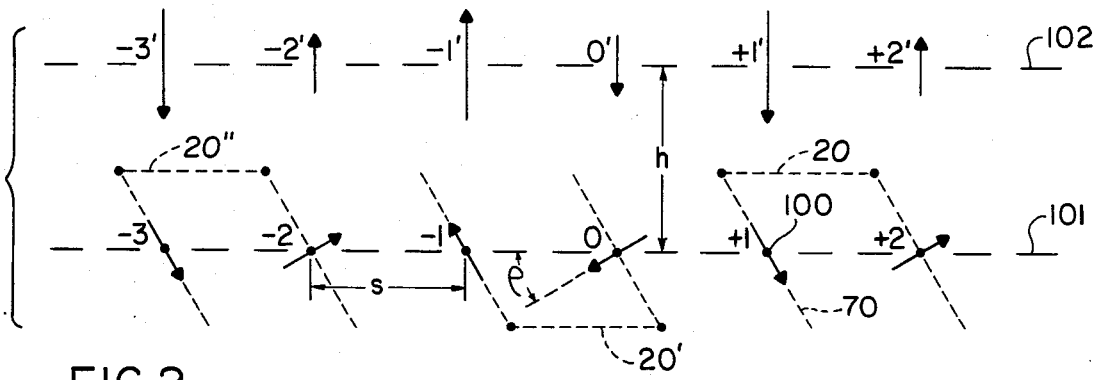
FIG. 2 is a diagram showing the substitution of magnetic dipoles for permanent magnets to explain the operation of the invention.

FIG. 2 shows the permanent magnet rotors and control magnets of the invention represented by magnetic dipoles. Rotor dipoles −3, −2, −1, 0, +1 and +2, which have identical magnetic moments $M_r$, are rotatable about parallel coplanar axes 100 that are uniformly spaced apart a distance s. Dipole 0 makes an angle $\rho$ with a straight line 101 that passes through the centers of the rotor dipoles. Mechanical links 20″, 20′ and 20 form the dipoles into pairs (−3−2), (−1,0) and (+1+2), respectively, wherein the individual dipoles are mutually perpendicular. Furthermore, the dipoles in one pair are reversed relative to the corresponding dipoles in the adjacent pairs. For example, dipole 0 is reversed relative to dipoles −2 and +2.

A series of control field dipoles −3′, −2′, −1′, 0′, +1′ and +2′, which have identical moments $M_c$, are supported for rotation in unison about an axis 102 parallel to the rotor centerline 101 and spaced a distance h therefrom. The axis 102 lies in the plane perpendicular to the rotational axes that intersects the centerline 101. The center of each control dipole is positioned opposite the correspondingly designated rotor dipole. For example, control dipole 0′ is opposite rotor dipole 0 with which it primarily couples.

Each control dipole is perpendicular to the supporting axis 102 and to the adjacent control dipoles, every other control dipole being reversed. The dipole 0′ makes an angle λ with respect to the plane parallel to the axes 100 that intersects the axis 102. Accordingly, the vectors associated with 0′ and −1′ in FIG. 2 represent $M_c\sin\lambda$ and $-M_c\cos\lambda$, respectively.

The rotor dipole pair (−1,0) is typical of the intermediate pairs in a long series. Rotor dipoles −2 and 0 and control dipoles −2′, −1′ and 0′ are sufficiently close to dipole −1 to exert appreciable torques thereon. Likewise, rotor dipoles −1 and +1 and control dipoles −1′, 0′, and +1′ exert appreciable torques on dipole 0. The sum of eight of these torques is zero, leaving only control torques $$Q_{-1-1'}=-2M_rM_c[\cos\lambda\sin\rho]/h^3 \quad (2)$$

and $$Q_{0,0'}=2M_rM_c[\sin\lambda\cos\rho]/h^3. \quad (3)$$

The link 20 adds $Q_{-1-1'}$ and $Q_{0,0'}$ to give a resultant control torque $$Q_c=2M_rM_c[\sin(\lambda-\rho)]/h^3. \quad (4)$$

This torque vanishes at equilibrium when $\sin(\lambda-\rho)$ is zero. Thus, $$\rho=\lambda. \quad (5)$$

However, the angle ρ of the last rotor dipole pair at either end of the series differs slightly from λ because two of the balancing torques are absent. Torques $Q_{0+1}$ and $Q_{0+1'}$ will be absent if rotor dipole pair (+1+2) is omitted, and rotor dipole pair (−1,0) will not reach equilibrium until $Q_c - Q_{0+1} - Q_{0+1'}=0$. Under this condition $$2M_rM_c[\sin(\lambda-\rho)]/h^3-M_r^2[1+\sin^2\rho]/s^3-M_cM_r\cos\lambda[\cos\rho+\sin\theta\sin(\theta-\rho)]/d^3=0 \quad (6)$$

where $\theta\equiv\tan^{-1}(h/s)$ and $d\equiv s/\cos\theta$.

Likewise, if rotor dipole pair (−3−2) is omitted torques $Q_{-1-2}$ and $Q_{-1-2'}$ will be absent and rotor dipole pair (−1,0) will not reach equilibrium until $Q_c - Q_{-1-2} - Q_{-1-2'}=0$. Under this condition $$2M_rM_c[\sin(\lambda-\rho)]/h^3+M_r^2[1+\cos^2\rho]/s^3+M_cM_r\sin\lambda[\sin\rho-\sin\theta\cos(\theta+\rho)]/d^3=0. \quad (7)$$

Fortunately, the error $\lambda-\rho$ is less than ±4 degrees in a typical embodiment where $s/h=2$ and $M_c/M_r=2$. Greater values of these ratios reduce the error.

The adjacent control magnets are supported with their magnetic axes as precisely mutually perpendicular as practicable when employed to adjust the common attitude of parallel louvers in a Venetian blind type of screen. However, the control apparatus is equally suitable for turning the louvers of a linear Fresnel reflector wherein the attitudes of adjacent pairs of louvers differ by an angle that is dependent upon the relative transverse position of the louvers in the screen. For this purpose, the support member holding the control magnets is formed with a twist about the axis 102 that varies at a non-uniform rate along its length. Assuming a twist of 2ε degrees between the control dipoles 0′ and −1′, the vectors associated with these dipoles represent $M_c\sin(\lambda-\epsilon)$ and $-M_c\cos(\lambda+\epsilon)$, respectively. Summing the ten relevant torques and equating to zero, reveals that the rotor angle ρ equals the control angle λ with a maximum error of ±ε in the typical embodiment previously mentioned. The error is a minor fraction of one degree in a practical case.

DETAILED DESCRIPTION OF A PREFERRED EMBODIMENT

Figure 7:
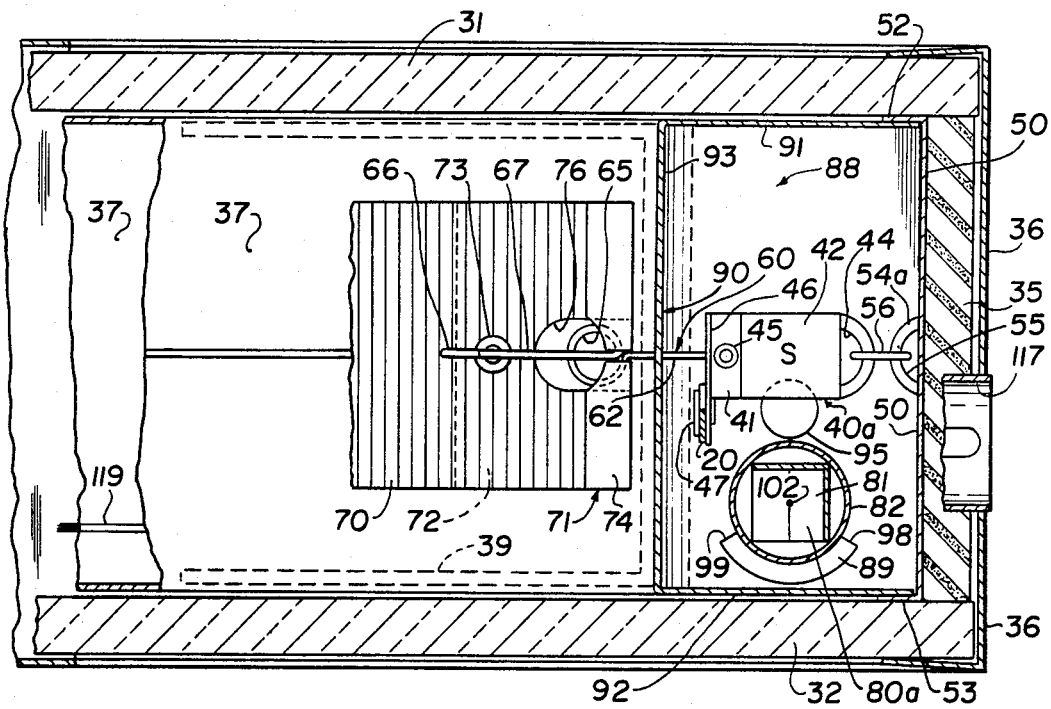
FIG. 7 is a plan cross section of the portion of the screen of FIGS. 5 and 6 taken along the line 7—7.
Figure 5:
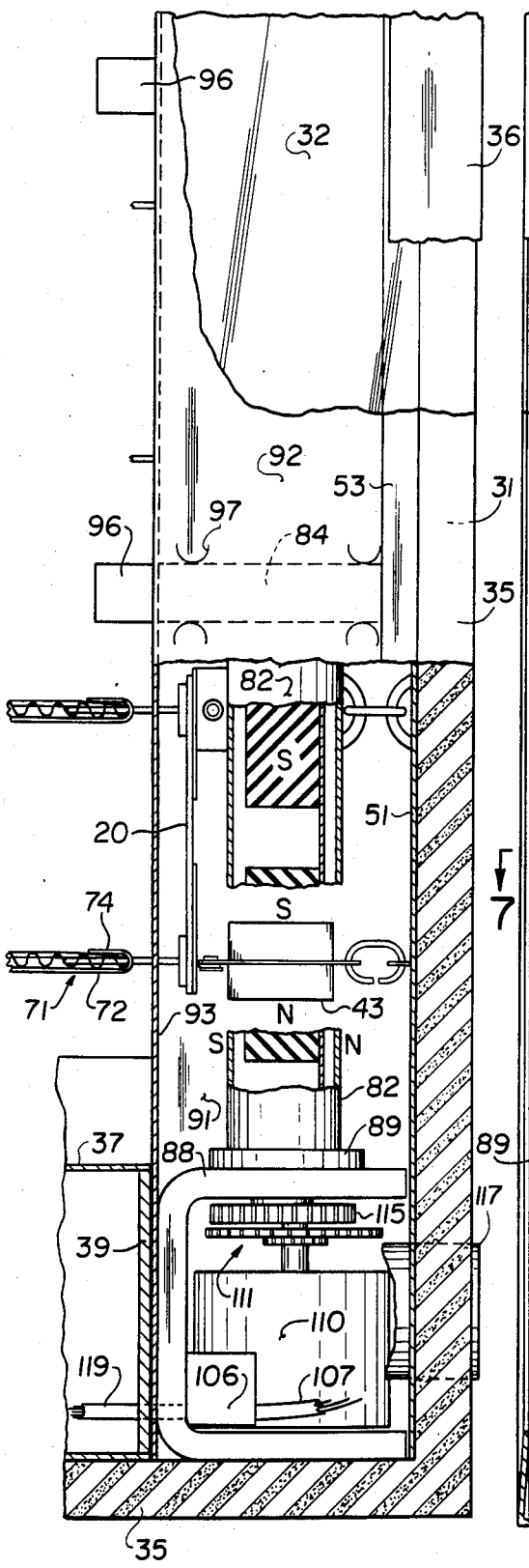
FIG. 5 is an elevational view of the lower right corner of an environmental screen incorporating the invention, seen from indoors with portions broken away to reveal internal construction.
Figure 6:
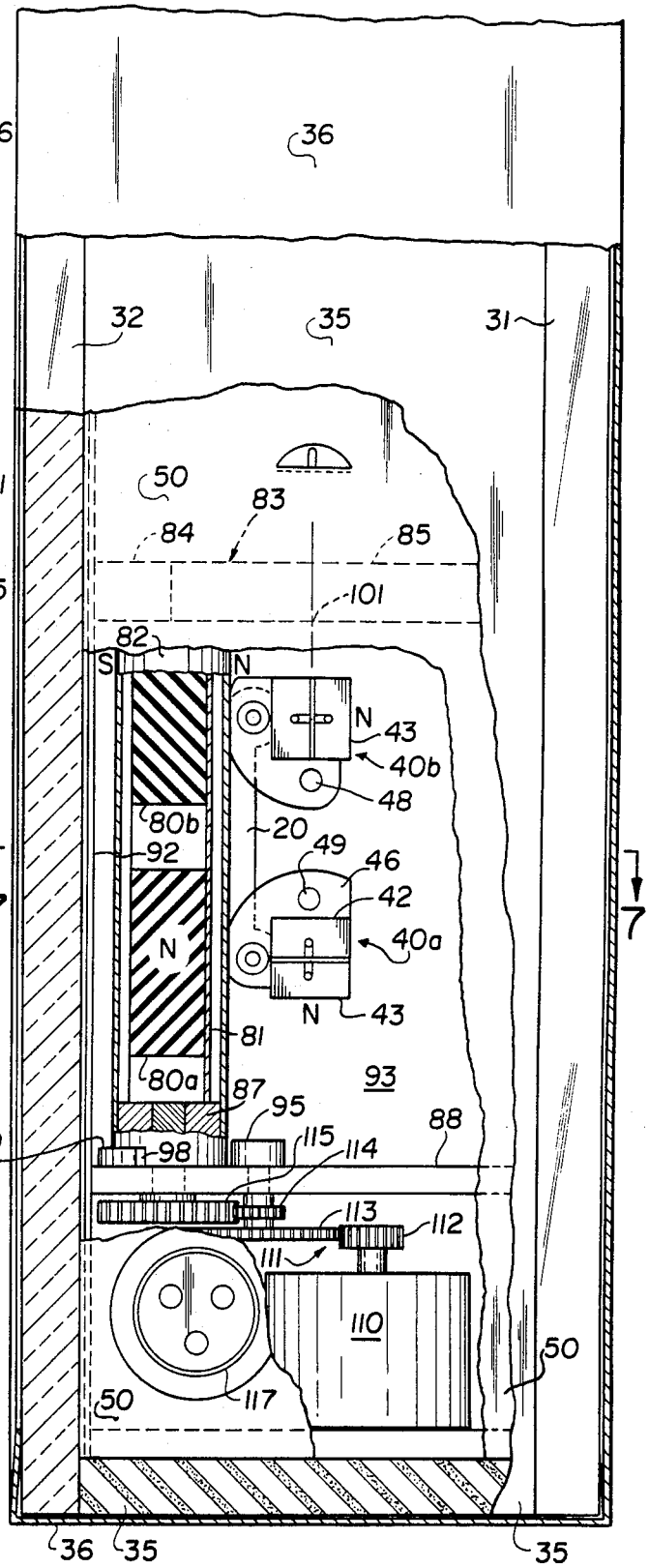
FIG. 6 is an end elevational view corresponding to FIG. 5 with portions broken away to reveal particularly the relationship of control field magnets to permanent magnet rotors.

The apparatus for wide angle control of permanent magnet rotors is shown in FIGS. 5–7 as incorporated in a screen that comprises an array of reflective aluminum foil louvers 70 held under tension by their ends for rotation about parallel uniformly spaced horizontal axes 100 and enclosed in an air space between a pair of glass plates 31 and 32 of a dual-glazed window or clerestory. Each end of every louver 70 is attached to a separate permanent magnet rotor 40 that is housed in a steel beam 90 on the right side of the screen (facing outdoors) and a similar beam (not shown) on the left side. A lower strut 37 and an upper strut (not shown) hold the two beams apart against the combined tensions on the louvers.

The beam 90 is a channel of sheet steel having a rectangular U-shaped cross section comprising parallel flanges 91 and 92 adjacent the glass plates 31 and 32, respectively, and separated by a web 93 bounding the air space. A bracket 39 fixed to the beam web 93 makes a sliding fit with the interior of the strut 37 and serves as a rigid corner connector to the beam 90. A beam cover 50 extends between the free ends of the flanges 91 and 92 and closes the three-sided beam 90. An adhesive plastic sealant 35 is spread over the bottom of the lower strut 37, the outside of the beam cover 50, the upper strut (not shown) and the left beam cover (not shown) between the edges of the plates 31 and 32 to seal the dual-glazed unit hermetically. A protective channel 36 surrounds the perimeter of the plates to guard the edges of the glass.

Each rotor 40 has a lammellar armature 41 on opposite faces of which a pair of permanent magnets 42 and 43 are fixed to produce magnetic flux perpendicular to the axis 100 of rotation. The armature 41 is a thin plate of hard tempered metal having a circular hole 44 at one end centered on the axis 100. An oval link 56 of hard wire hanging from the beam cover 50 threads through the hole 44 and supports the rotor for limited rotation about the axis 100. At the other end of the armature 41, an eyelet 45 centered on the axis 100 holds a coupling 60 that provides a torsionally stiff connection to the louver 70.

The rotor magnets 42 and 43 are made of rubber-bonded barium ferrite flat strips having a high tack, pressure sensitive adhesive layer on the surface in contact with the armature 41. The magnets 42 and 43 extend axially from the center of the hole 44 to adjacent the eyelet 45 and have a width coextensive with the armature. The thickness of each magnet is approximately one half its width; consequently the cross section of the rotor 40 perpendicular to the axis 100 is substantially square.

An apron 46 that is integral with the armature 41 projects perpendicularly to the rotor axis 100. The apron 46 is perforated by circular holes 48 and 49 having centers equidistant from the axis 100 and forming with the axis 100 the apexes of an imaginary right isosceles triangle.

Figure 3:
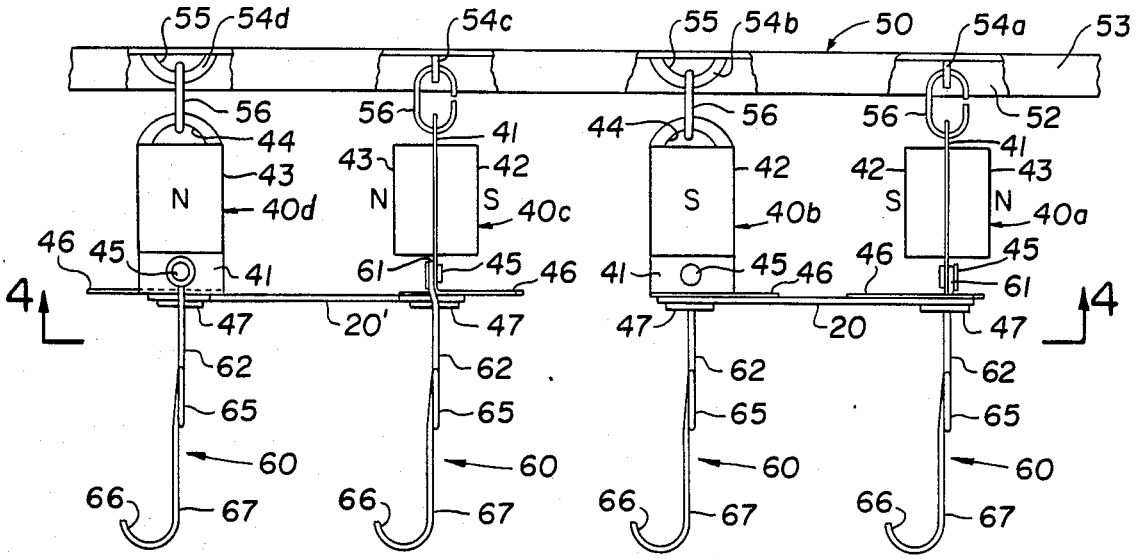
FIG. 3 shows two pairs of linked rotors viewed perpendicularly to the plane containing their rotational axes.
Figure 4:
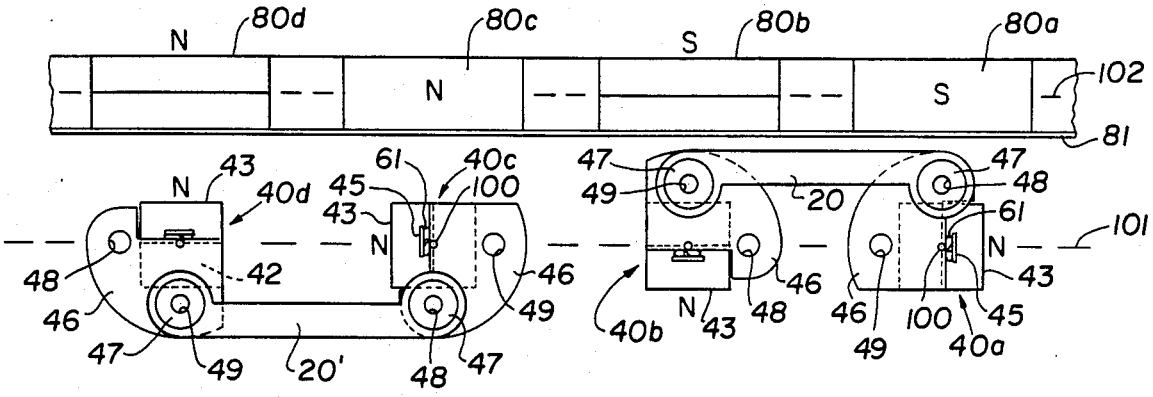
FIG. 4 is a view parallel to the rotational axes of the rotors of FIG. 3 taken along the line 4—4, showing means for linking each rotor to an adjacent rotor and means producing permanent magnetic control fields.

Particular rotors 40*a*, 40*b*, 40*c* and 40*d* are shown in FIGS. 3 and 4 removed from the screen assembly for greater clarity. Rotors 40*a* and 40*b* are coupled by a link 20 in the shape of a flat connecting rod having an effective length equal to the spacing between the adjacent rotor axes. The ends of the link 20 are rotatably held by eyelets 47 mounted in holes 48 and 49 in the aprons 46 of rotors 40*a* and 40*b*, respectively, to complete a parallel crank four-bar linkage. A link 20' similar to link 20 joins rotors 40*c* and 40*d*. However, link 20' is positioned on the opposite side of the centerline 101 from link 20. Links 20 and 20' are preferably made of a self-lubricating plastics material having a low coefficient of friction.

Links 20 and 20' maintain the magnetic axes of the mechanically coupled rotors mutually perpendicular and serve to transmit torques between the rotors within each rotor pair. Furthermore, it is to be observed that the magnetic axes of rotors 40*a* and 40*b* are directly opposite to the magnetic axes of rotors 40*c* and 40*d*, respectively.

The angular positions of the rotors 40 are determined by the rotational angles of control field permanent magnets 80, which are rotatable in unison about the axis 102 parallel to the centerline 101. A control magnet 80 is positioned opposite each rotor 40 in flux linking relationship thereto. Typically, control magnets 80*a*, 80*b*, 80*c* and 80*d* couple primarily with rotors 40*a*, 40*b*, 40*c* and 40*d*, respectively. The magnetic axis of each control magnet 80 is perpendicular to the rotational axis 102 and perpendicular to the next control magnet. Furthermore, the magnetic axes of every other control magnet in the series are oppositely directed. Thus, the magnetic axis of control magnet 80*a* is perpendicular to the magnetic axis of control magnet 80*b* and opposite to the magnetic axis of control magnet 80*c*.

Each control field permanent magnet 80 is formed of two identical strips of rubber-bonded barium ferrite that are uniformly magnetized through their thickness dimensions and sandwiched together to provide a square cross section. The length of each magnet 80 is somewhat less than the spacing between adjacent rotor axes 100. The magnets 80 are secured by adhesive to a non-magnetic support member 81 that has an L-shaped cross section shown in FIG. 7.

The support member 81 is contained within a thin-walled non-magnetic cylindrical tube 82. The tube 82 extends the full length of the beam 90 past all permanent magnet rotors 40. The tube 82 is supported where needed by bearings. A typical bearing 83 is a rectangular partition of plastics material having a low frictional coefficient. The bearing extends transversely across the interior of the beam 90 and is fixed in position midway between adjacent rotor axes by dimples 97 projecting from the inside faces of the flanges 91 and 92. The bearing 83 is split into two parts 84 and 85 to provide two halves of a cylindrical bushing surrounding the tube 82.

Means for turning the control field magnets 80 comprises an electrical step motor 110 connected through reduction gearing 111 to a cylindrical plug 87 that is inserted in and supports the lower end of the tube 82. The motor 110 and gearing 111 are mounted within a yoke 88 that is positioned in the beam 90 adjacent the end of the strut 37. The upper end (not shown) of the tube 82 is free to move axially to to accomodate relative movement between the tube and the beam 90 with temperature changes.

The plug 87 has a collar 89 that lies against the yoke 88, extends part way around the tube 82 and projects radially sufficiently beyond the tube to provide contact faces 98 and 99 at its circumferential ends that cooperate with a stop pin 95 fixed in the yoke 88 to limit the rotation of the control magnets 80 to about ±110 degrees.

The step motor 110 is connected through a terminal board 116 and over conductors 118 to a hermetically sealed recessed three-pin receptable 117 adjacent the lower right corner of the dual-glazed unit. The reduction gearing 111 comprises a driving pinion 112 on the shaft of the motor 110 that engages an intermediate gear 113. A pinion 114 attached to the gear 113 meshes with a driven gear 115 fixed to the plug 87, which holds the tube 82 containing the control magnets 80.

Control potentials are supplied to the receptacle 117 from a source (not shown) external to the dual-glazed unit when it is desired to rotate the tube 82. No electrical power is required to hold the control magnets 80 stationary because there is no resultant torque thereon when the rotors 40 are at rest.

Similar rotor control apparatus (not shown) is provided in the left beam of the screen responsive to control potentials supplied from terminal board 116 over conductors 119, which are connected in parallel with conductors 118. Angular synchronism between the rotors at opposite ends of the louvers is achieved by applying control potentials to the receptacle 117 until the step motors 100 have both stalled after turning the associated tubes 82 to the limiting angle imposed by the collars 89 and stop pins 95.

Returning now to FIG. 3, the beam cover 50 comprises a thin, spring-tempered metal strip having parallel edges bent to form parallel stiffening lips 52 and 53. Tabs 54*a*, 54*b*, 54*c* and 54*d*, each containing a circular hole 55, project perpendicularly from the longitudinal centerline of the cover 50 toward rotors 40*a*, 40*b*, 40*c* and 40*d*, respectively. The tabs are conveniently formed by slitting the cover 50 in approximately semicircular outlines and bending tab 40*a* about a line perpendicular to the centerline of the cover 50, tab 40*b* about a line parallel to this centerline, tab 40*c* like 40*a*, and tab 40*d* like 40*b* in an alternating perpendicular and parallel series along the beam cover 50.

The links 56 hang from the holes 55 in the tabs 54 and serve as self-aligning suspensions for the rotors offering low frictional torque. The link 56 is made of small diameter music wire having a high tensile strength. It turns through roughtly half the angle of rotation of the armature 41. The beam cover 50 may be made of stainless steel and the armature 41 of beryllium copper, both tempered to very high tensile strength. The metal thicknesses are greatly exaggerated in the drawings and are as thin as practicable. The edges of the holes 44 and 55 are fully rounded by suitable shot peening to avoid any mechanical restoring torque arising within the required range of rotational angles.

The louver couping 60 comprises a short length of wire of circular cross section having a closed circular eye 61 at one end, a louver fastening eye 65 intermediate its length, and a hook 66 at the other end. The eye 61 is held against a face of the rotor armature 41 by the eyelet 45. A straight stem 62 extends from the eye 61 along the axis 100 to the louver fastening eye 65, which forms an almost full circle. The hook 66 is connected to the eye 65 by a shank 67 that passes across the diameter of the eye 65 in an approximately coaxial extension of the stem 62.

The desired angle between the magnetic axis of the rotor 40 and the plane of the louver 70 is provided by a parallel or perpendicular relationship between the planes of the eyes 61 and 65. The eyelet 45 is made with a shoulder (not shown) that abuts the armature 41 and leaves sufficient clearance for the eye 61 for self-alignment of the rotational axes of the rotor 40 and the stem 62.

A circular hole (not shown) on the centerline of the beam perforates the web 93. The diameter of this hole is large enough to pass the eye 65 of the coupling 60. A louver closing limit stop 96 is provided in the form of a rectangular tab slit and bent from the web 93 parallel to the centerline 101 and midway between rotor axes 100. The limit stop 96 ensures that the louvers can all be tightly closed upon rotating the tube 82 somewhat more than ±90 degrees. This is practicable even when the screen is constructed to operate as a Fresnel reflector with non-parallel louvers when open.

Referring particularly to FIG. 7, each louver 70 is made of a corrugated ribbon of spring-temper, high strength aluminum foil. The axes of the corrugations extend parallel to the width of the louver to stiffen it transversely and to render it longitudinally resilient. An analysis of this type of louver is contained in U.S. Pat. No. 3,342,244 granted Sept. 19, 1967. A thin layer of pure aluminum is preferably deposited on the alloy substrate of the louver to maximize its reflectance and minimize its emissivity.

A louver terminal 71 protects the end of the louver and provides means for attaching the eye 65 of the coupling 60 to the louver. The terminal 71 has a rectangular flat plate portion 72, which is secured against a face of the louver by an eyelet 73 centered on the rotational axis, and a narrow transverse rim 74 formed by a U-bend, which extends from the plate portion 72 around the extreme transverse edge of the louver. The end of the louver nests within the rim 74 except adjacent the axis 100 where the rim and louver are cut away by notches 75 and 76, respectively, sufficiently to accomodate the stem 62 and to permit the eye 65 to lie parallel to and against the plate portion 72.

Assembly of the beam cover 50, the beam 90 and the louver 70 is facilitated by holding the rotor 40 on the axis 100 until the hook 66 on the coupling 60 projects through the beam web 93 and can be gripped. The cover 50 is then placed against the beam 90 with the lips 52 and 53 overlapping the flanges 91 and 92, respectively, and temporarily deflected toward the interior of the beam until the apron 46 contacts the inside of the web 93. This deflection provides sufficient clearance between the eye 65 and the outside of the web 93 to permit the eye 65 to be received in the notch 76 of the louver and to be slid into the pocket formed by the rim 74.

I claim:

1. Apparatus for simultaneously adjusting the angles of a series of permanent magnet rotors having parallel coplanar transversely spaced rotational axes, comprising means for mechanically linking each rotor to an adjacent rotor to form a plurality of rotor pairs having magnetic axes mutually perpendicular and perpendicular to said rotor axes of rotation, means for coupling each rotor to a direct magnetic control field component perpendicular to the plane common to rotor axes, and means for varying the amplitude ratio of adjacent field components coupled to the rotors of a linked pair according to the tangent of a control angle to turn the pair of rotors through a corresponding angle.

2. Apparatus according to claim 1 wherein the means for coupling each rotor to a direct magnetic control field component comprises means producing permanent magnetic control fields that are rotatable in unison about an axis parallel to the common plane of the rotor axes, the magnetic axis of the control field that couples with one rotor being perpendicular to the control field that couples with its paired rotor, whereby control torques induced in the linked rotors balance at angles equal to the rotational angles of the control field components.

3. Apparatus for simultaneously adjusting the angles of a series of permanent magnet rotors having parallel coplanar transversely spaced rotational axes, each rotor having a magnetic axis directed substantially perpendicular to its rotational axis, comprising means for mechanically linking each rotor to an adjacent rotor for maintaining said magnetic axes thereof mutually perpendicular, a series of control field permanent magnets rotatable about a common axis parallel to the common plane of said rotor axes, each control magnet being primarily magnetically coupled to a respective rotor and having a magnetic axis directed substantially perpendicularly to said common axis, perpendicularly to the magnetic axis of the next longitudinally adjacent control magnet, and oppositely to the magnetic axis of the next but one longitudinally adjacent control magnet, and means for simultaneously adjusting the rotational angles of said control magnets to apply a torque to each rotor that balances the torque applied to its linked rotor at the desired rotor angles.

4. Apparatus for controlling the angles of a plurality of permanent magnet rotors that are rotatabale about transversely spaced coplanar axes in response to magnetic fields acting perpendicularly to said axes, comprising a series of control field permanent magnets having a supporting axis parallel to a line joining the centers of said rotors and coplanar therewith, a control magnet being positioned opposite a respective rotor and having a magnetic axis perpendicular to the magnetic axes of the longitudinally and adjacent control magnets, linking means grouping said rotors into adjacent pairs of first and second rotors, said first and second rotors having magnetic axes perpendicular to each other and opposite to said magnetic axes of said first and second rotors of adjacent pairs, and means for turning said control magnets in unison about said axis of support to rotate said rotors through an equal angle.

* * * * *